US006510568B1

(12) United States Patent
Drobinski et al.

(10) Patent No.: US 6,510,568 B1
(45) Date of Patent: Jan. 28, 2003

(54) PLAYYARD

(75) Inventors: Jerome J. Drobinski, Reading, PA (US); Carl J. Simmons, NOlensville, TN (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 09/508,779

(22) PCT Filed: Sep. 18, 1998

(86) PCT No.: PCT/US98/19685

§ 371 (c)(1),
(2), (4) Date: May 24, 2000

(87) PCT Pub. No.: WO99/14459

PCT Pub. Date: Mar. 25, 1999

(30) Foreign Application Priority Data

Sep. 19, 1997 (US) ..... 60/059335

(51) Int. Cl.[7] ..... A47D 7/00
(52) U.S. Cl. ..... 5/93.1; 5/99.1
(58) Field of Search ..... 5/93.1, 98.1, 99.1; 403/102, 315, 325, 329, 324

(56) References Cited

U.S. PATENT DOCUMENTS

| | | | | |
|---|---|---|---|---|
| 4,811,437 | A | 3/1989 | Dillner et al. | |
| 5,279,006 | A | 1/1994 | Teng | |
| 5,358,220 | A | 10/1994 | Yu-Kuang | |
| 5,381,570 | A | 1/1995 | Cheng | |
| 5,504,951 | A | 4/1996 | Yeh | |
| 5,533,215 | A | 7/1996 | Malofsky et al. | |
| 5,561,874 | A | 10/1996 | Malofsky et al. | |
| 5,611,634 | A | 3/1997 | Wang | 403/102 |
| 5,615,427 | A | 4/1997 | Huang | |
| 5,697,111 | A | 12/1997 | Dillner et al. | |
| 5,819,342 | A | 10/1998 | Williams | |
| 5,906,013 | A | 5/1999 | Wang | 5/99.1 |
| 6,082,922 | A | 7/2000 | Cheng | 403/102 |
| 6,223,366 | B1 * | 5/2001 | Cheng | 5/99.1 |
| 6,250,837 | B1 | 6/2001 | Mariol et al. | |

OTHER PUBLICATIONS

Portion of prior art top rail assembly for use in a playyard, obtained from Lerado (Zhong Shan) Industrial Co. Ltd. (China), two photographs and two line drawings of assembly depicted in photographs.

* cited by examiner

*Primary Examiner*—Lynne H. Browne
*Assistant Examiner*—Fredrick Conley
(74) *Attorney, Agent, or Firm*—Barnes & Thornburg

(57) ABSTRACT

A playyard top rail comprising a left rail and a right rail pivotably coupled to the left rail to enable pivotable movement of the right rail relative to the left rail about a pivot axis, and wherein the right rail is formed to include a locking aperture, and also including a lock coupled to the left rail, and wherein the lock includes a lock button arranged along the left rail displaced a distance from the pivot axis to move between a locked position extended into the locking aperture formed in the right rail to block pivotable movement of the right rail relative to the left rail and an unlocked position withdrawn from the locking aperture formed in the right rail to allow pivotable movement of the right rail relative to the left rail.

39 Claims, 7 Drawing Sheets

PLAYYARD

BACKGROUND AND SUMMARY OF THE INVENTION

The present invention relates to a juvenile playyard, and particularly to a collapsible frame for a juvenile playyard. More particularly, the present invention relates to a collapsible playyard frame including floor support rails, feet for elevating and supporting a floor mat in a juvenile playyard, and lockable top rails.

According to the present invention, a playyard top rail includes a left rail and a right rail pivotably coupled to the left rail to enable pivotable movement of the right rail relative to the left rail about a pivot axis. The right rail is formed to include a locking aperture.

The playyard top rail further includes a lock coupled to the left rail. The lock includes a lock button arranged to move between locked and unlocked positions. In the locked position, the lock button is extended into the locking aperture formed in the right rail to block pivotable movement of the right rail relative to the left rail. In the unlocked position, the lock button is withdrawn from the locking aperture formed in the right rail to allow pivotable movement of the right rail relative to the left rail.

In preferred embodiments, the playyard top rail is adapted to be integrated into a playyard frame that includes four corner legs, a corner piece at the top end of each corner leg, and a corner foot at the bottom end of each corner leg. The playyard frame further includes a lockable playyard top rail in accordance with the present invention interconnecting each pair of adjacent corner pieces so that there are four such playyard top rails in all. Also in preferred embodiments, the lock includes a pair of lock buttons biased by a spring normally to extend into companion locking apertures formed in the right rail to establish the locked positions of the lock buttons upon pivoted movement of the right rail relative to the left rail to assume an in-line position.

Additional features and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
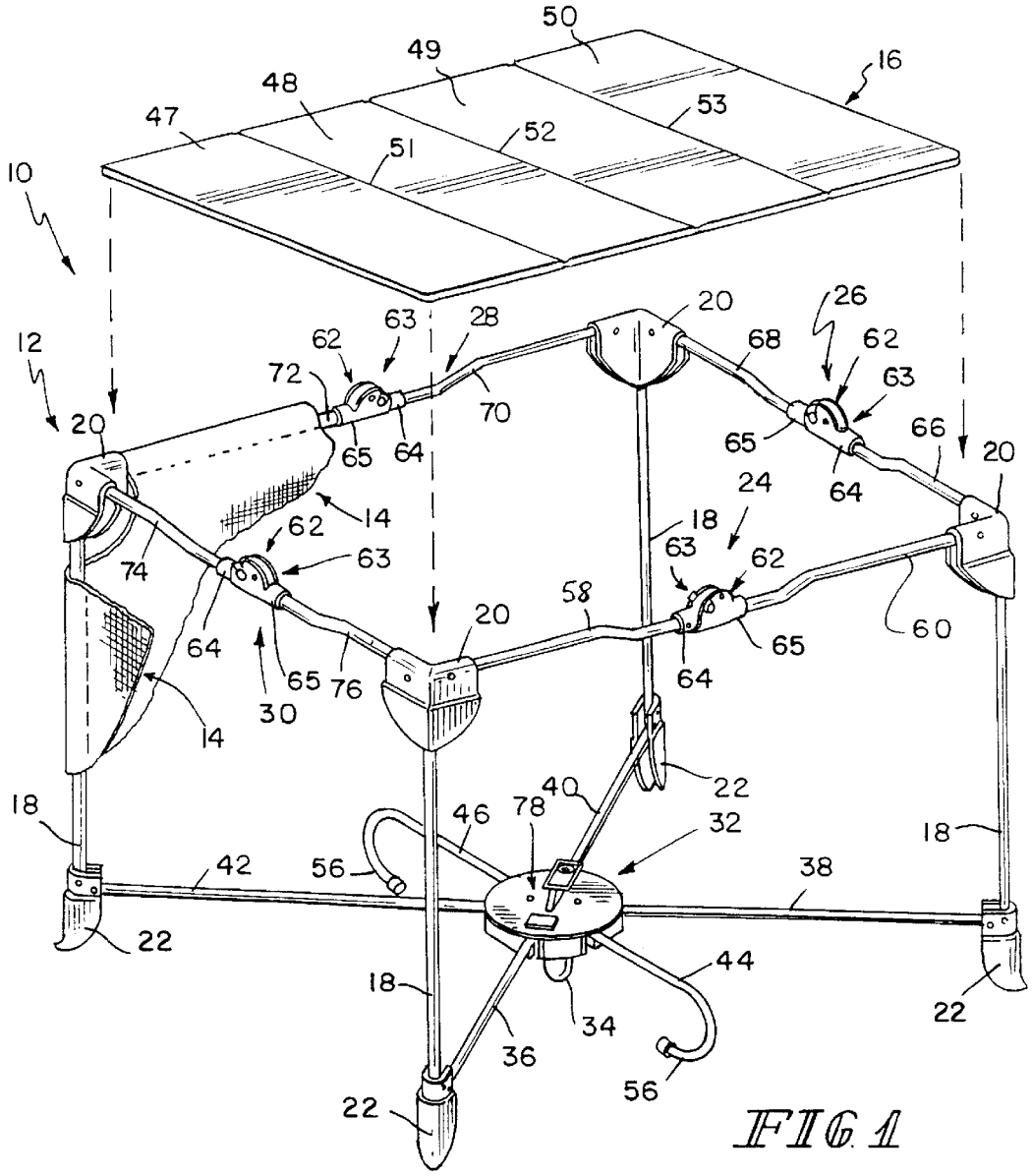
FIG. 1 is a perspective view of a collapsible playyard including a frame in accordance with the present invention, a fabric frame cover, and a floor mat for installation in the frame.

Playyard 10 includes a collapsible frame 12, fabric frame cover 14, and removable floor mat 16. Frame cover 14 is made of sturdy fabric and netting material and is foldable to enable frame 12 to be moved easily from an erected configuration shown in FIGS. 1–4 to a collapsed configuration shown in FIGS. 6–8. Floor mat 16 is removed from frame 12 (as shown in FIG. 1) prior to collapsing frame 12. Once frame 12 is collapsed, the four-segment floor mat 16 can be folded, "wrapped" around collapsed frame 12, and secured using straps (not shown) to provide a "case" for storing and/or carrying collapsed frame 12.

Collapsible frame 12 includes four corner legs 18, a corner piece 20 at the top end of each corner leg 18, and a corner foot 22 at the bottom end of each corner leg 18. Frame 12 also includes a foldable top rail 24, 26, 28, or 30 interconnecting each pair of adjacent corner pieces 20. Frame 12 further includes a rail mount 32, a foot 34 for elevating rail mount 32, and a support rail 36, 38, 40, or 42 interconnecting rail mount 32 and each of the corner feet 22. Frame 12 also includes two auxiliary support rails 44, 46 coupled to rail mount 32.

Floor mat 16 includes four sections 47, 48, 49, and 50 arranged in series as shown in FIG. 1. Section 47 is coupled to section 48 at fold line 51, section 48 is coupled to section 49 at fold line 52, and section 49 is coupled to section 50 at fold line 53. Floor mat 16 can be "unrolled" to assume the flat configuration shown in FIG. 1 and then dropped in place to provide a sturdy playyard floor supported in an elevated position above the ground 54 underlying playyard 10 by rail mount 32 and support rails 36, 38, 40, 42, 44, and 46.

Figure 6:
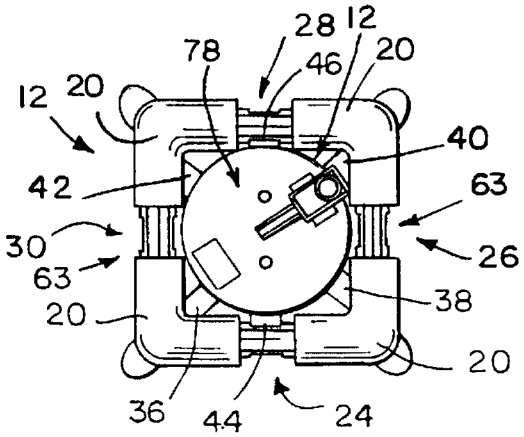
FIG. 6 is a top plan view of the playyard of FIG. 2 after the floor mat has been removed and the playyard frame has been fully collapsed showing the rail mount, six support rails pivotably coupled to the rail mount, and a pair of diagonally spaced releasable rail locks positioned in the rail mount to lie between two diagonally spaced-apart, lockable support rails.
Figure 8:
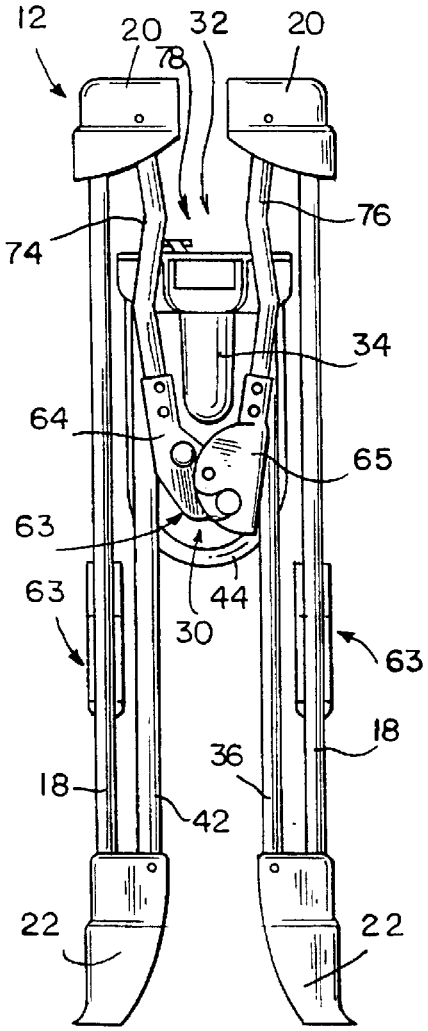
FIG. 8 is an end elevation view of the fully collapsed playyard frame of FIG. 6.
Figure 7:
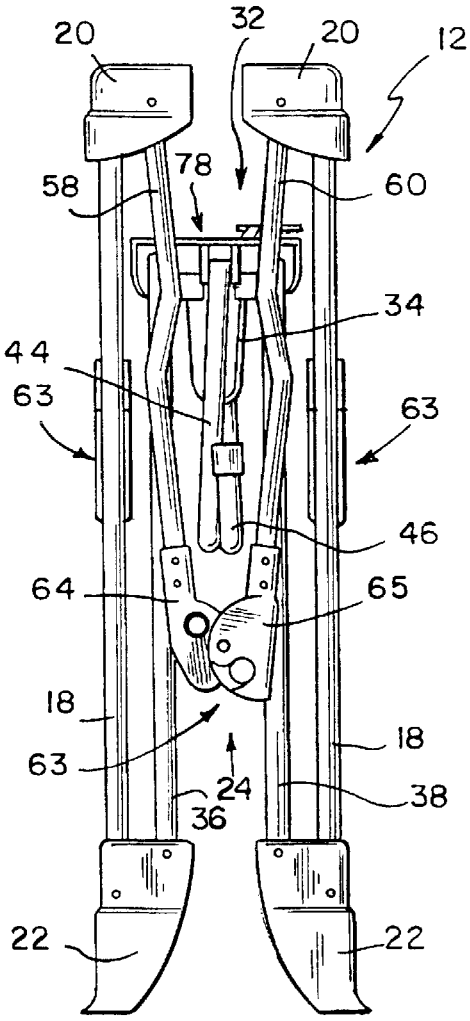
FIG. 7 is a side elevation view of the fully collapsed playyard frame of FIG. 6.

Each of support rails 36, 38, 40, and 42 has an outer end pivotably coupled to one of the corner feet 22 and an inner end pivotably coupled to rail mount 32 so as to facilitate collapsing movement of frame 12 from its erected configuration shown in FIGS. 1–4 to its collapsed configuration shown in FIGS. 6–8. Each of auxiliary support rails 44 and 46 has an inner end pivotably coupled to rail mount 32 and an outer end formed to define a rail support foot 56 as shown, for example, in FIGS. 1 and 4. Once assembled, support rails 36, 38, 40, and 42 are arranged to lie in an X-shaped pattern, auxiliary support rail 44 is arranged to bisect the included angle defined by support rails 36 and 38, and auxiliary support rail 46 is arranged to bisect the included angle defined by support rails 40 and 42.

Figure 2:
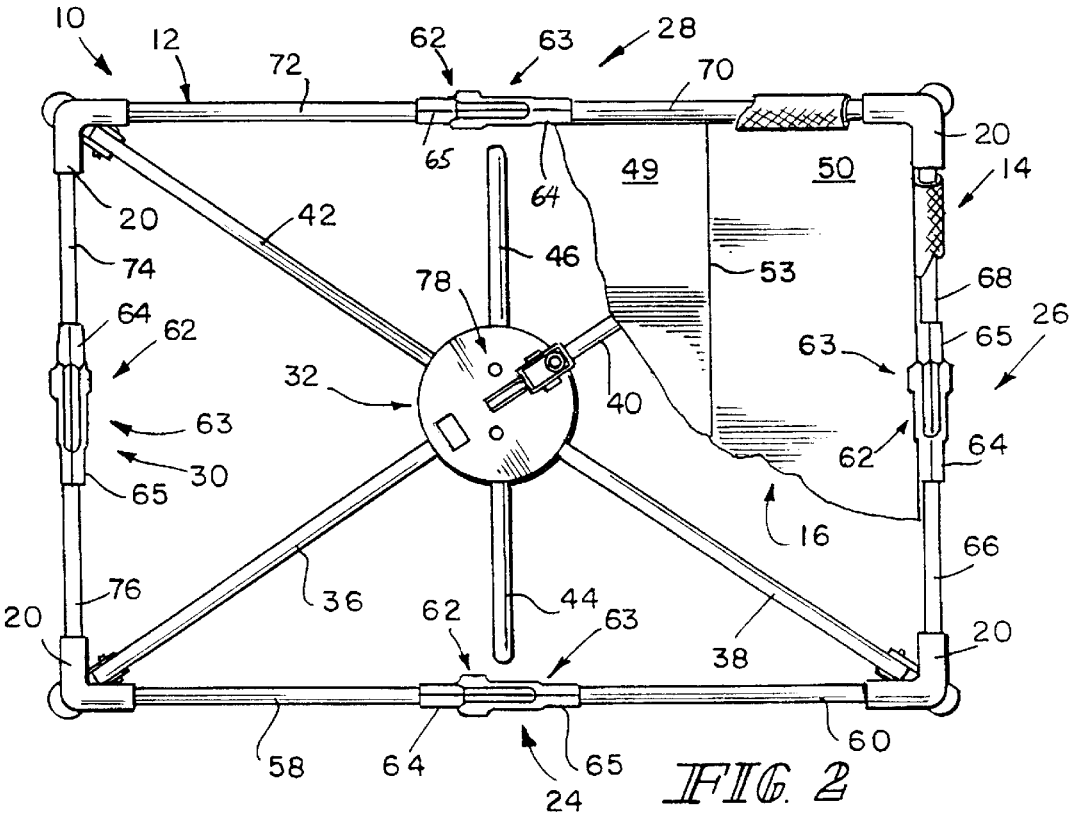
FIG. 2 is a top plan view of the playyard of FIG. 1, with portions broken away, showing an arrangement of six support rails pivotably coupled to a rail mount and positioned to underlie and support the floor mat now installed in the frame and showing four top rails arranged in a rectangular pattern above and around the support rails, each top rail including left and right rail segments and a releasable segment lock.
Figure 3:
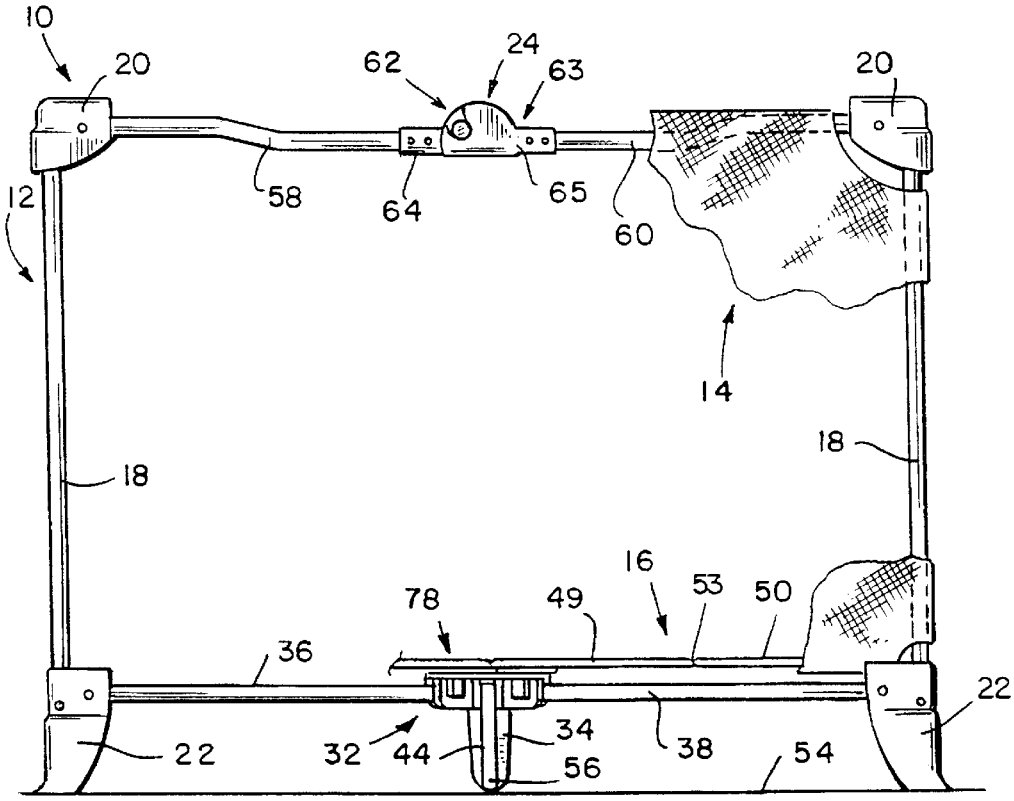
FIG. 3 is a side elevation view of the playyard of FIG. 2 showing a foot appended to the underside of the rail mount to support the rail mount in an elevated position above the ground underlying the floor mat.
Figure 4:
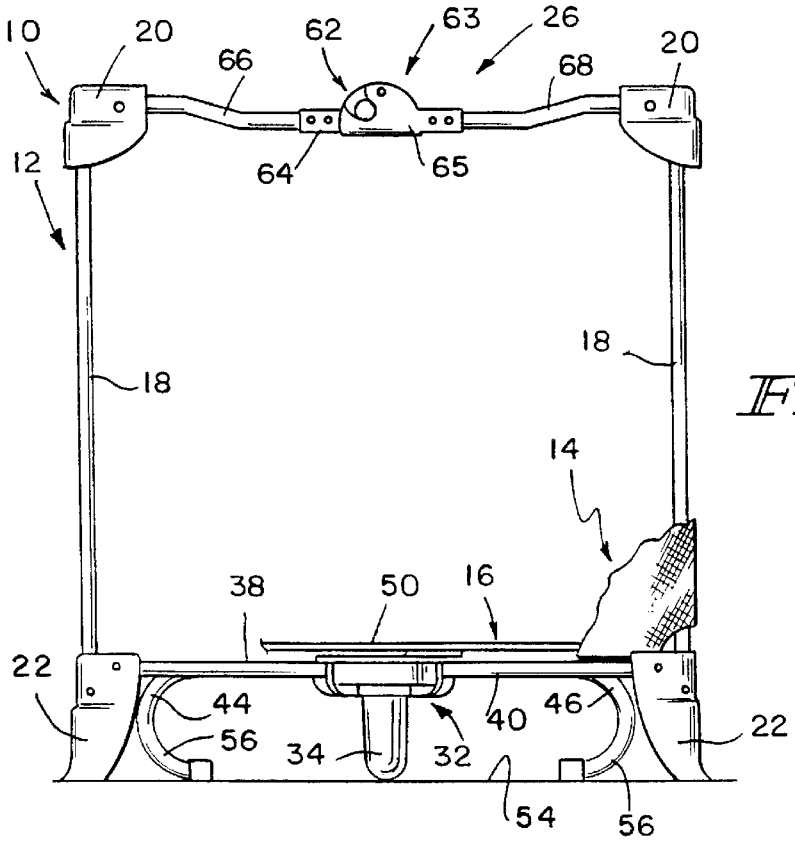
FIG. 4 is an end elevation view of the playyard of FIGS. 2 and 3.

Front top rail 24 includes a left rail segment 58 pivotably coupled to one of the corner pieces 20, a right rail segment 60 coupled for pivotable movement relative to left rail segment 58 (in, for example, the manner described below) and to an adjacent corner piece 20, and a releasable segment lock 62 configured and mounted to "lock" the left and right rail segments 58, 60 together in an in-line relation one to another as shown, for example, in FIGS. 1–3 upon movement of frame 12 to its erected configuration.

Releasable segment lock 62 is mounted in a two-piece lock housing 63 having a left portion 64 rigidly coupled to left rail segment 58 and a right portion 65 rigidly coupled to right rail segment 60 and pivotably coupled to left portion 64. Left rail segment 58 and left portion 64 (of lock housing 63) cooperate to form a left rail of front top rail 24. Right rail segment 60 and right portion 65 (of lock housing 63) cooperate to form a right rail of front top rail 24. It is within the scope of this disclosure to form left rail segment 58 and left portion 64 as a single piece and to form right rail segment and right portion 65 as a single piece.

Each of right-side top rail 26, rear top rail 28, and left-side top rail is similar in structure to front top rail 24 in that each includes a two-piece lock housing 63 containing a releasable segment lock 62. Right-side top rail 26 includes a left rail segment 66 pivotably coupled to one of the corner pieces 20 and rigidly coupled to a left portion 64 of a second lock housing 63 and a right rail segment 68 pivotably coupled to an adjacent corner piece 20 and rigidly coupled to a right portion 65 of the second lock housing 63. Rear top rail 28 includes a left rail segment 70 pivotably coupled to one of the corner pieces 20 and rigidly coupled to a left portion 64 of a third lock housing 63 and a right rail segment 72 pivotably coupled to an adjacent corner piece 20 and rigidly coupled to a right portion 65 of the third lock housing 63. Left-side top rail 30 includes a left rail segment 74 pivotably coupled to one of the corner pieces 20 and rigidly coupled to a left portion 64 of a fourth lock housing 63 and a right rail segment 76 pivotably coupled to an adjacent corner piece 20 and rigidly coupled to a right portion 65 of the fourth lock housing 63.

A releasable rail lock apparatus 78 is provided in rail mount 32 and configured to lock certain of the support rails 36, 38, 40, 42 to rail mount 32 when frame 12 is in its erected configuration as shown in FIG. 1. In the illustrated embodiment, rail lock apparatus 78 is configured to engage each of support rails 36, 40 and thereby block pivoting movement of the support rails 36, 40 relative to rail mount 32 when frame 12 is in its erected configuration as shown in FIG. 1 so as to prevent collapsing movement of frame 12 to its collapsed configuration. Rail lock apparatus 78 is configured to be releasable so that a user, after first removing floor mat 16 to expose rail mount 32, can manually actuate rail lock apparatus 78 to disengage a locked connection established between rail mount 32 and support rails 36, 40, thereby allowing pivoting movement of the now unlocked support rails 36, 40 relative to rail mount 32 as shown, for example, in FIG. 5 during controlled collapse of frame 12.

Figure 5:
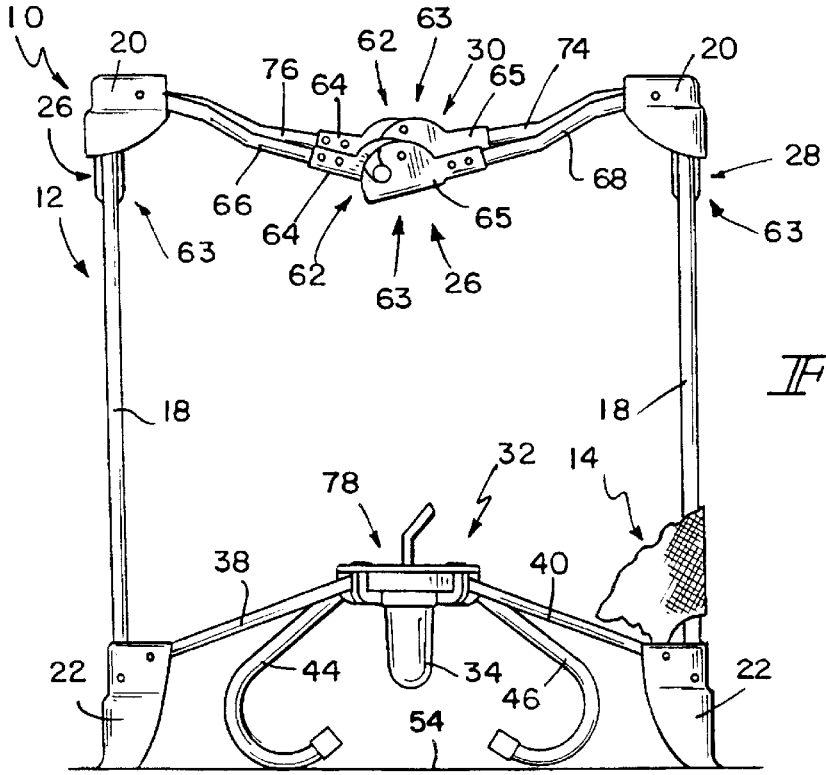
FIG. 5 is a view similar to FIG. 4 of the playyard as it is being collapsed and following unlocking of the rail mount from certain of the pivotable support rails and upward movement of the rail mount away from the ground underlying the playyard (and pivoting movement of the support rails relative to the rail mount) and then release of the segment locks in each of four top rails to allow relative movement of left and right rail segments in each of the four top rails toward collapsed positions.

Referring now to FIGS. 1 and 5, playyard 10 can be collapsed by removing floor mat 16, manually actuating releasable rail lock apparatus 78 and then raising rail mount 32 away from ground 54 to collapse support rails 36, 38, 40, 42, 44, 46 partially, and then manually actuating each of the four releasable segment locks 62 to collapse top rails 24, 26, 28, 30 partially. Then frame 12 can be collapsed further to assume a fully collapsed configuration shown, for example, in FIGS. 6–8. Finally, if desired, floor mat 16 can be wrapped around collapsed frame 12 and secured using suitable means to provide a storage case or carrying case for collapsed frame 12.

Figure 9:
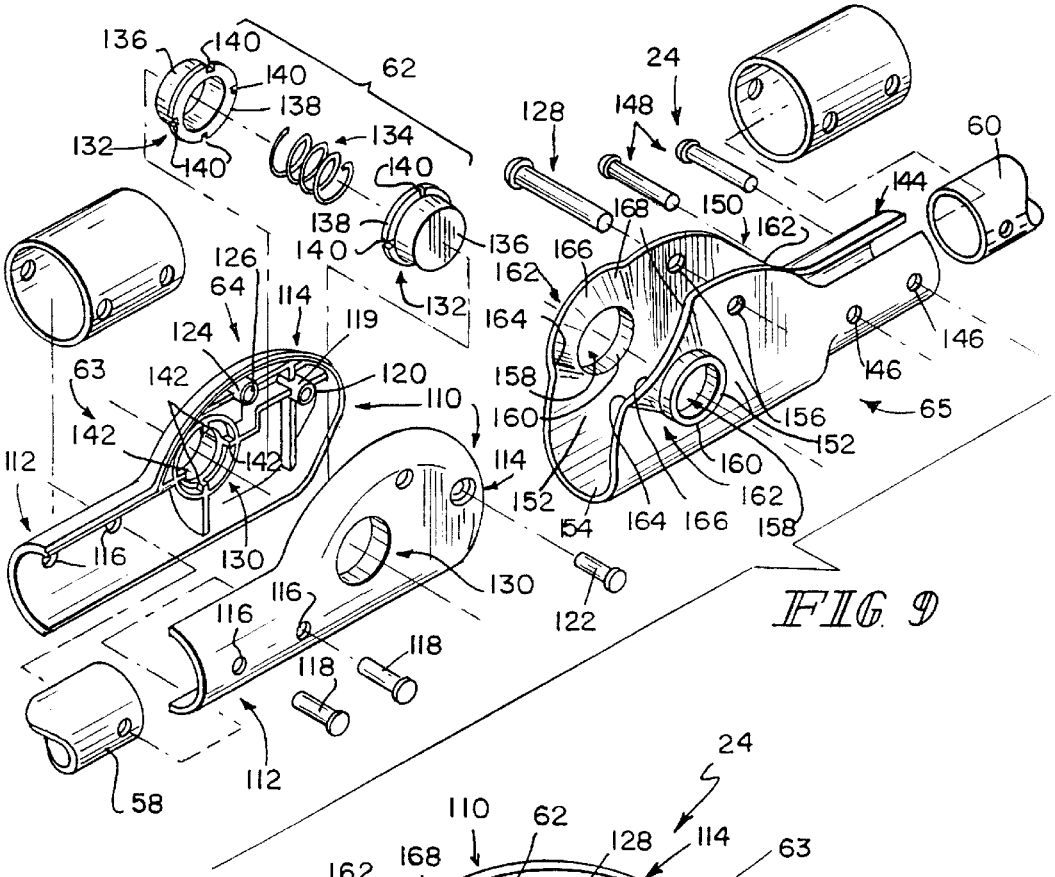
FIG. 9 is an exploded perspective view of a portion of a foldable top rail showing a lock housing comprising a two-piece left portion, a one-piece right portion, several fastener and pivot pins, and a releasable segment lock including two lock buttons and a button-biasing spring.

Referring to FIG. 9, left housing portion 64 (in the illustrated embodiment) includes two clamshells 110 configured to be coupled one to another at, for example, a shiplap joint to define a lock housing 53 containing releasable segment lock 62 therein. Each clamshell 110 is made of a plastics or other suitable material and includes a rail grip portion 112 and a chamber portion 114 appended to rail grip portion 112. Rail grip portion 112 is formed to include apertures 116 for receiving fasteners 118 therein to connect clamshells 110 rigidly to left rail segment 58. Chamber portion 114 is formed to include a fastener post 119 including aperture 120 for receiving fastener 122 therein to hold distal ends of clamshell 110 together. Chamber portion 114 is also formed to include a pivot post 124 formed to include an aperture 126 for receiving pivot pin 128 therein to establish pivot axis 129 and a button-mount aperture 130 for receiving a lock button included in releasable segment lock 62 therein. Cylindrical sleeves 100 are provided to cover and surround the joint between left rail segment 58 and left housing portion 62 and the joint between right rail segment 60 and right housing portion 65.

Releasable segment lock 62 includes two lock buttons 132 and a button-biasing spring 134 as shown in FIG. 9. Each lock button 132 includes a cylindrical button member 136 sized to pass through button-mount aperture 130 formed in clamshell 110. Each button member 136 includes a touch pad 137 at an outer end of button member 136 and a retainer flange 138 appended to an inner end of cylindrical button member 136. Retainer flange 138 has a ring shape (or other suitable shape) and is sized to block passage of the entire lock button 132 through button-mount aperture 130 under a force-applied by button-biasing spring 134 so as to limit movement of lock button 132 through button-mount aperture 130. An annular flange stop 139 is provided in lock housing 63 to engage retainer flange 138 to limit movement of button member 136 through button-mount aperture 130. It is within the scope of this disclosure to provide one or more flange stops (of any suitable size and shape) in lock housing 63 instead of the annular flange stop 139 shown, for example, in FIG. 1.

Retainer flange 138 is formed to include radial guide channels 140 for receiving circumferentially spaced-apart anti-rotation ribs 142 formed in clamshell 110 to ring around an inner wall thereof and button-mount aperture 130. The anti-rotation ribs 142 are received in the radial guide channels 140 to block rotation of the lock buttons 132 about axis 143 (which is parallel to pivot axis 129) during movement of each lock button 132 into and out of its companion locking aperture. Axis 143 defines a substantially straight path along which lock buttons 132 may move. Button-biasing spring 134 is a coiled compression spring or other suitable button-urging apparatus.

Figure 10:
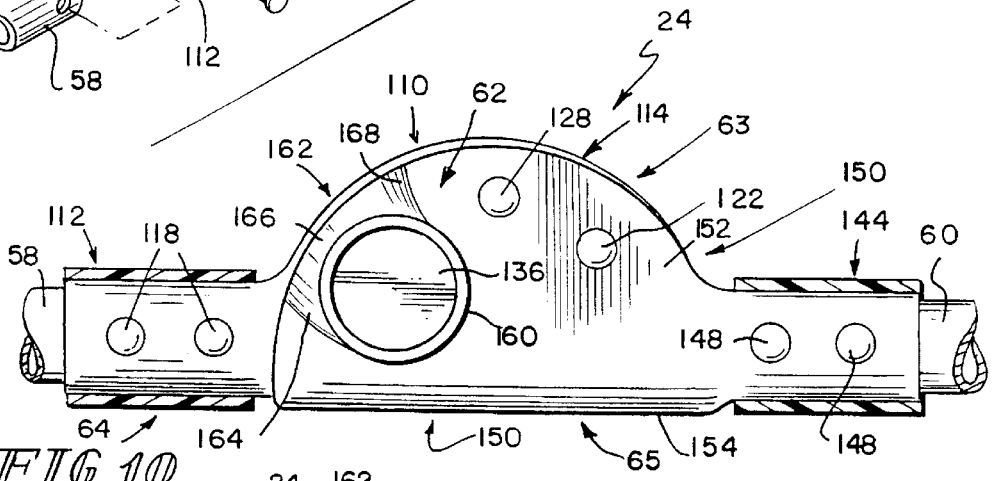
FIG. 10 is a side elevation view of the lock housing portions of FIG. 9 showing the left portion of the lock housing rigidly coupled to a left rail segment included in the foldable top rail, the right portion of the lock housing rigidly coupled to a right rail segment included in the foldable top rail, and one of the spring-biased lock buttons coupled to the left housing portion in a locking position in a locking aperture formed in the right housing portion to "lock" the left and right rail segments in the foldable top rail together in an in-line relation upon movement of the playyard frame to its erected configuration (see FIG. 1)
Figure 11:
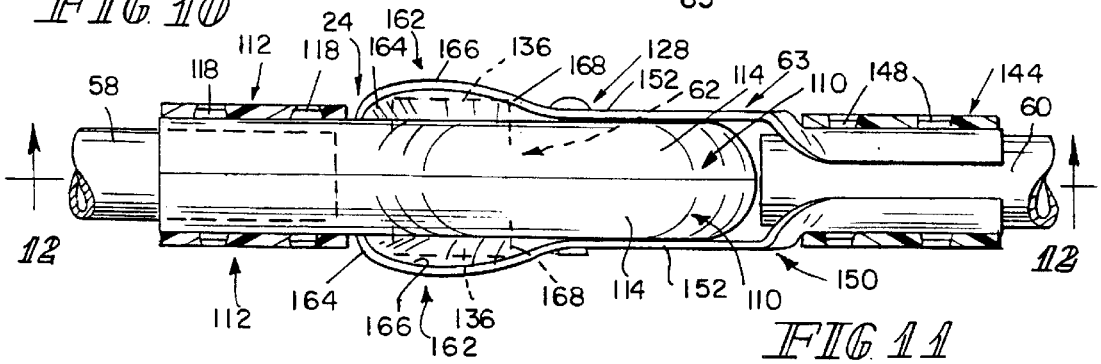
FIG. 11 is a top plan view of the top rail portion shown in FIG. 10 showing a pair of funnel-like cam ramps formed on the right housing portion and arranged to extend in opposite directions and guide the outwardly biased lock buttons mounted on the left housing portion into locking apertures formed in the right housing portion.
Figure 12:
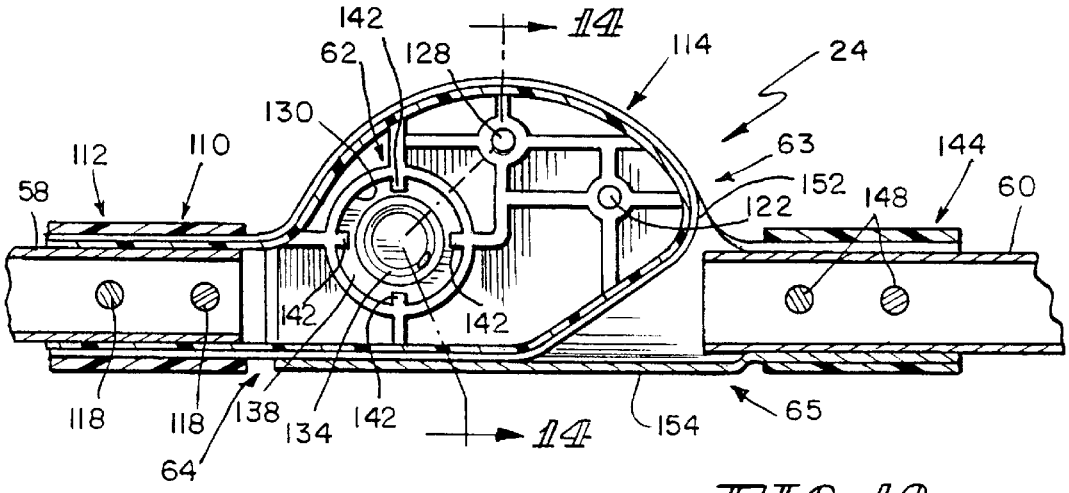
FIG. 12 is a sectional view of the top rail portion shown in FIGS. 10 and 11 taken along line 12—12 of FIG. 11 showing engagement of the left and right portions of the lock housing, establishment of a pivot axis for the left and right housing portions by a pivot pin positioned to lie near the top of the lock housing, and placement of one of the lock buttons in the left housing portion and the button-biasing spring against an inner surface of the lock button.
Figure 13:
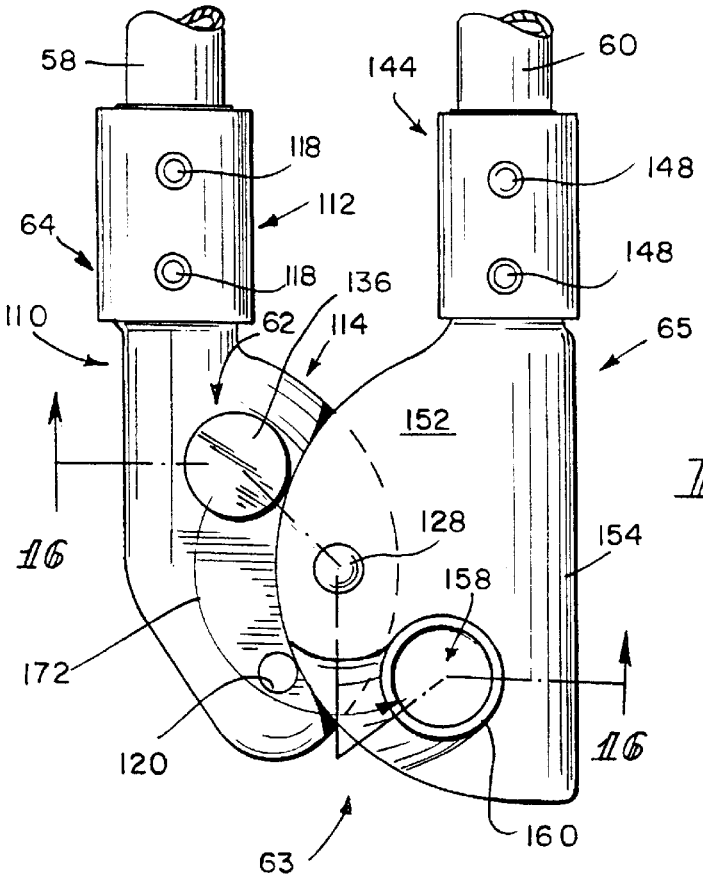
FIG. 13 is a side elevation view of the top rail portion shown in FIGS. 10–12 after it has been pivoted to its fully collapsed position as shown in FIG. 7.

Right housing portion 65 is made of metal or other suitable material and includes a tubular rail grip portion 144 formed to include apertures 146 for receiving fasteners 148 therein to connect right housing portion 65 rigidly to right rail segment 60 and a saddle-shaped, lockable frame 150 (resembling a taco shell) sized to receive and partially surround chamber portion 114 of left housing portion 64 therein as shown in FIGS. 9–11. Frame 150 includes a pair of spaced-apart, half moon-shaped, side walls 152 and a curved bottom wall 154 integrally appended to lowermost "edges" of the half moon-shaped side walls 152. Each side wall 152 is formed to include a pivot pin-receiving aperture 156, a tunnel-shaped locking aperture 158 surrounded by a border ring 160, and a funnel-like cam ramp 162 including front, side, and rear camming surfaces 164, 166, and 168, respectively. Locking apertures 158 are positioned to align with button-mount apertures 130 when left housing portion 64 is mounted in and coupled to right housing portion 65.

Figure 14:
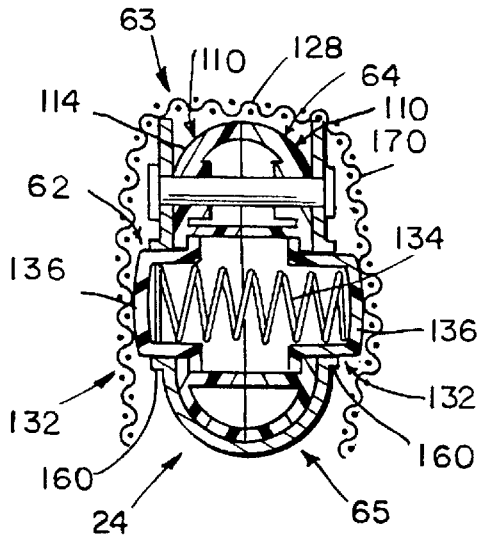
FIG. 14 is a sectional view of a portion of the top rail assembly taken along line 14—14 of FIG. 12 showing outward movement of the two lock buttons in opposite directions under the urging of the button-biasing spring to extend into the two spaced-apart locking apertures formed in the right housing portion.
Figure 15:
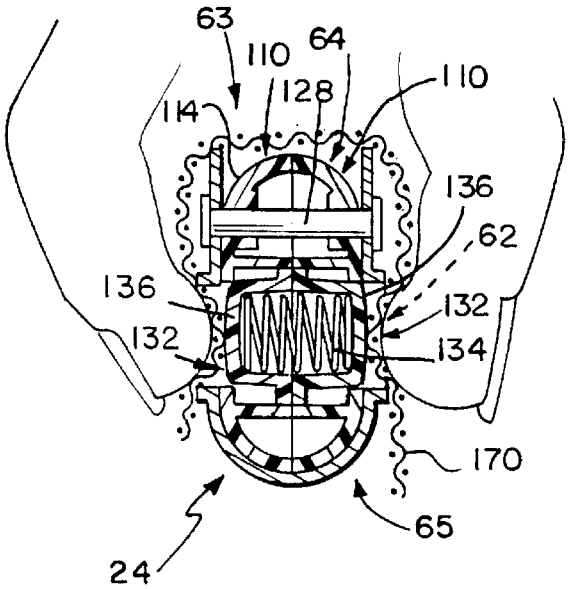
FIG. 15 is a view similar to FIG. 14 showing finger-actuated movement of the two lock buttons toward one another and against the button-biasing spring positioned to lie therebetween to release the right housing portion for pivotable movement relative to the left housing portion about the horizontal pivot axis established by the pivot pin.
Figure 16:
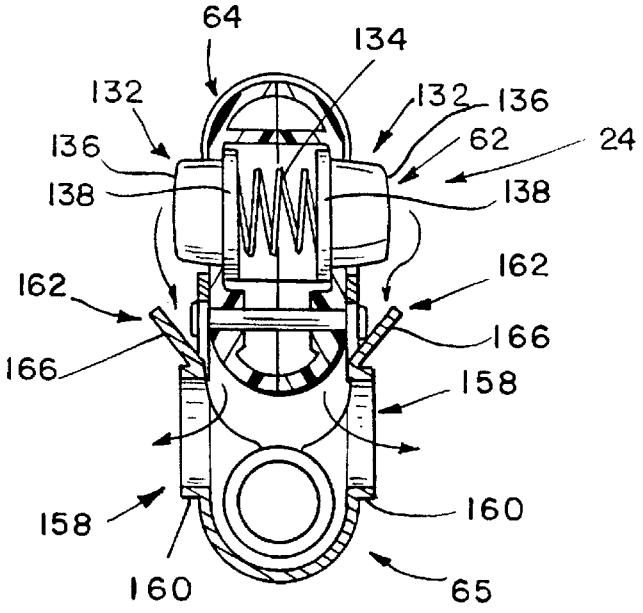
FIG. 16 is a sectional view taken along line 16—16 of FIG. 13 showing the path of the two lock buttons through the funnel-like cam ramps formed on the right housing portion as the left and right housing portions are pivoted from the fully collapsed configuration shown in FIGS. 7 and 13 to the in-line erect configuration shown in FIGS. 1, 10–12, and 14.

Spring 134 is positioned to lie between the two lock buttons 132 as shown, for example, in FIGS. 14–16. Spring 134 is sized to urge the two lock buttons 132 in opposite directions into the locking apertures 158 formed in the right portion 65 of lock housing 63 to block pivotable movement of the right rail segment 60 relative to the left rail segment 58 about pivot axis 129 upon pivoted movement of the right rail segment 60 relative to the left rail segment 58 to assume an in-line position as shown, for example, in FIGS. 1–3 and 10–12. Spring 134 is arranged in lock housing 63 normally to urge each button member 136 in a selected direction to pass its touch pad 137 through a companion locking aperture to a ready-to-press position as shown, for example, in FIG. 14.

Manual actuation of releasable segment lock 62 is shown, for example, in FIGS. 14 and 15 wherein front top rail 24 is covered with fabric 170. The lock buttons 132 mounted in left housing portion 64 are moved toward one another and against button-biasing spring 134 to disengage lock buttons 132 from locking apertures 158 formed in right housing portion 65. The user is now free to pivot the released right housing portion 65 about pivot pin 128 (and pivot axis 129) relative to left housing portion 64 to facilitate collapse of frame 12 in the manner described above.

As shown diagrammatically in FIG. 16, funnel-like cam ramps 162 engage lock buttons 132 and urge, guide, and move those lock buttons 132 inwardly and automatically against spring 134 and toward one another as left housing portion 64 is pivoted about pivot pin 128 relative to right housing portion 65 in counterclockwise direction 172 as shown in FIG. 10 to reach the in-line position shown in FIGS. 10 and 11. Internal camming surfaces 164, 166, 168 cause lock buttons 132 to compress spring 134 as left housing portion 64 is rotated inside right housing portion 65. This permits lock buttons 132 to move from their least extended position and then back to their most extended position when the top rail lock mechanism is fully engaged. Funnel-like cam ramps 162 thus cause segment lock 62 to be "reset" automatically to lock left and right housing portions 64, 65 to one another to form a "single" rigidified structure interconnecting left and right rail segments once the frame 12 is moved to assume its erect configuration as shown in FIG. 1.

Spring-loaded lock buttons 132 function to allow the top rails 24, 26, 28, 30 of playyard 10 to be extended to their erected positions and locked into position without secondary actions on the part of the operator. Lock buttons 132 are configured to be found and released easily by the operator of playyard 10 by pressing the lock buttons 132 through fabric 170 forming the top rail "cover" of playyard 10. Segment lock 62 operates to allow top rails 24, 26, 28, 30 to fold in such a way that playyard 10 is folded into a compact form for easy storage and transportation.

The top rail lock mechanism comprising left and right housing portions 64, 65 and releasable segment lock 62 is configured to define a rigid, non-twisting structure having a minimum number of parts and a low manufacturing cost. This mechanism 62, 64, 65 is configured for one-handed operation and requires no secondary activity by the operator to lock the left and right rail segments in each of top rails 24, 26, 28, 30 to one another in an in-line relation as playyard 10 is erected.

Although the invention has been described in detail with reference to certain preferred embodiments, variations and modifications exist within the scope and spirit of the invention as described and defined in the following claims.

What is claimed is:

1. A playyard top rail comprising a left rail, a right rail pivotably coupled to the left rail to enable pivotable movement of the right rail relative to the left rail about a pivot axis, the right rail being formed to include a locking aperture, and a lock coupled to the left rail, the lock including a lock button arranged along the left rail displaced a distance from the pivot axis to move between a locked position extended into the locking aperture formed in the right rail to block pivotable movement of the right rail relative to the left rail and an unlocked position withdrawn from the locking aperture formed in the right rail to allow pivotable movement of the right rail relative to the left rail.

2. The top rail of claim 1, wherein the left rail includes a lock housing formed to include a button-mount aperture and the lock button is positioned to extend into the button-mount aperture in the locked and unlocked positions of the lock button.

3. The top rail of claim 2, wherein the lock housing is formed to include an interior region housing the lock button.

4. The top rail of claim 3, wherein the lock further includes a spring positioned to lie in the interior region of the lock housing and the lock button is arranged to engage the spring and move into and out of the locking aperture formed in the right rail during movement of the lock button between the locked and unlocked positions.

5. The top rail of claim 2, wherein the lock housing also includes an anti-rotation rib positioned to lie adjacent to the button-mount aperture, the lock button is formed to include a guide channel, and the lock button is positioned to engage the anti-rotation rib in the guide channel during movement of the lock button between the locked and unlocked positions of the lock button.

6. The top rail of claim 2, wherein the lock housing also includes a flange stop positioned to lie adjacent to the button-mount aperture, the lock button includes a button member including a touch pad at an outer end and a retainer flange at an inner end, the touch pad is arranged to move in the locking aperture formed in the right rail during movement of the lock button between the locked and unlocked positions, and the retainer flange is positioned to engage the flange stop to limit movement of the button member through the button-mount aperture.

7. The top rail of claim 6, wherein the lock further includes a spring arranged in the lock housing normally to urge the button member in a selected direction to engage the retainer flange of the button member and the flange stop of the lock housing.

8. The top rail of claim 6, wherein the lock further includes a spring arranged in the lock housing normally to urge the button member in a selected direction to pass the touch pad through the locking aperture to a ready-to-press position.

9. The top rail of claim 2, wherein the left rail further includes a left rail segment and the lock housing includes a rail grip portion coupled to the left rail segment and a chamber portion appended to the rail grip portion and formed to include the button-mount aperture.

10. The top rail of claim 9, wherein the chamber portion is formed to include the interior region, the right rail includes a pair of side walls arranged to lie in spaced-apart relation to one another to receive the chamber portion therebetween, and one of the side walls is formed to include a locking aperture arranged to align with the button-mount aperture upon pivoted movement of the right rail relative to the left rail about the pivot axis.

11. The top rail of claim 10, wherein the right rail further includes a curved bottom wall connected to a lower end of each of the side walls and arranged to cooperate with the side walls to define a saddle-shaped lockable frame configured to receive the chamber portion therein.

12. The top rail of claim 10, wherein the lock button includes a button member including inner and outer portions and a spring and the spring is arranged in the chamber portion to urge the outer portion of the button member into the locking aperture upon pivoted movement of the right rail relative to the left rail to assume an in-line position with the left rail while the inner portion of the button member lies in the button-mount aperture.

13. The top rail of claim 1, wherein the left rail includes a left rail segment and a lock housing coupled to the left rail segment and the lock button is mounted in the lock housing.

14. The top rail of claim 13, wherein the lock housing includes a first clamshell and a second clamshell coupled to the first clamshell to define an interior region and the lock button extends into the interior region.

15. The top rail of claim 14, wherein the first clamshell is formed to include the button-mount aperture.

16. The top rail of claim 13, wherein the right rail includes a right rail segment and a lockable frame coupled to the right rail segment and formed to include a locking aperture, the locking housing is pivotably coupled to the lockable frame, the button-mount aperture formed in the locking housing is arranged to align with the locking aperture formed in the lockable frame upon pivoted movement of the right rail relative to the left rail about the pivot axis to assure an in-line position with the left rail.

17. The slop rail of claim 16, wherein the lockable frame includes a pair of spaced-apart side walls and a curved bottom wall connected to a lower end of each of the side walls, the side walls and the bottom wall cooperate to define a saddle-shaped portion configured to receive the pivotable lock housing therein, and the locking aperture is formed in one of the side walls.

18. The top rail of claim 16, wherein the lock button extends into the button-mount aperture and the locking aperture upon pivoted movement of the right rail to the in-line position.

19. The top rail of claim 1, wherein the lock includes a button member and spring means for yieldably urging the button member into the locking aperture upon movement of the right rail relative to the left rail about a pivot axis to assume an in-line relation with the left rail.

20. A playyard top rail comprising a left rail, a right rail pivotably coupled to the left rail to enable pivotable movement of the right rail relative to the left rail about a pivot axis, a rail lock arranged to engage the left and right rails, the rail lock including first and second lock buttons and a compression spring positioned to lie between and engage the first and second lock buttons to urge the first and second lock buttons in opposite directions normally to block pivotable movement of the right rail relative to the left rail about the pivot axis upon pivoted movement of the right rail to assume an in-line position with the left rail.

21. The top rail of claim 20, wherein the left rail is formed to include a first button-mount aperture receiving the first lock button and a second button-mount aperture receiving the second lock button and the spring is arranged to urge the first lock button into the first button-mount aperture and the second lock button into the second button-mount aperture.

22. The top rail of claim 21, wherein the left rail includes a left rail segment and a left portion of a lock housing, the right rail includes a right rail segment and a right portion of a lock housing, and the left portion of the lock housing is formed to include the first and second button-mount apertures.

23. The top rail of claim 22, wherein the left portion of the lock housing includes a pair of clamshells coupled to one another and each clamshell is formed to include one of the button-mount apertures.

24. The top rail of claim 21, wherein the right rail is formed to include a first locking aperture arranged to align with the first button-mount aperture upon pivoted movement of the right rail relative to the left rail about the pivot axis to assume the in-line position with the left rail and a second locking aperture arranged to align with the second button-mount aperture upon pivoted movement of the right rail relative to the left rail about the pivot axis to assume the in-line position with the left rail, and the spring is sized to urge an outer portion of the first lock button into the first locking aperture and an outer portion of the second lock button into the second locking aperture upon pivoted movement of the right rail to the in-line position to lock the left rail and the right rail together in an in-line relation to one another.

25. The top rail of claim 24, wherein the first lock button includes a retainer flange positioned to engage the left rail to retain an inner portion of the first lock button in the first button-mount aperture upon movement of the outer portion of the first lock button into the first locking aperture and the second lock button includes a retainer flange positioned to engage the left rail to retain an inner portion of the second lock button in the second button-mount aperture upon movement of the outer portion of the second lock button into the second locking aperture.

26. The top rail of claim 24, further comprising means for blocking rotation of the first and second lock buttons about an axis parallel to the pivot axis during movement of the first lock button into and out of the first locking aperture and movement of the second lock button into and out of the second locking aperture.

27. The top rail of claim 24, wherein each of the first and second lock buttons is formed to include a guide channel and the left rail includes a first anti-rotation rib received in the guide channel formed in the first lock button and a second anti-rotation rib received in the guide channel formed in the second lock button.

28. The top rail of claim 20, wherein the left rail includes a left rail segment and a left portion of a lock housing and the right rail includes a right rail segment and a right portion of the lock housing and the rail lock is mounted in the left portion of the lock housing and arranged to move between a locked position engaging the left and right portions of the lock housing and an unlocked position disengaging the right portion of the lock housing while engaging the left portion of the lock housing.

29. The top rail of claim 28, wherein the left portion is formed to include a first button-mount aperture receiving the first lock button and a second button-mount aperture receiving the second lock button.

30. The top rail of claim 29, wherein the right portion is formed to include a first locking aperture arranged to align with the first button-mount aperture upon pivoted movement of the right portion relative to the left rail about the pivot axis to assume the in-line position with the left rail and a second locking aperture arranged to align with the second button-mount aperture upon pivoted movement of the right portion relative to the left rail about the pivot axis to assume the in-line position with the left rail, and the spring is sized to urge an outer portion of the first lock button into the first locking aperture and an outer portion of the second lock button into the second locking aperture upon pivoted movement of the right portion to the in-line position to lock the left rail and the right portion together in an in-line relation to one another.

31. The top rail of claim 20, wherein the rail lock is coupled to the left rail and the first and second lock buttons are constrained to move toward and away from one another along a straight path that is substantially parallel to the pivot axis.

32. The top rail of claim 31, wherein the right rail is formed to include a first locking aperture arranged to received the first lock button upon pivoted movement of the right rail relative to the left rail about the pivot axis to assume the in-line position with the left rail and a second locking aperture arranged to received the second lock button upon pivoted movement of the right rail relative to the left rail about the pivot axis to assume the in-line position with the left rail.

33. The top rail of claim 32, wherein the spring is sized to urge the first lock button along the straight path into the first locking aperture and the second lock button along the straight path into the second locking aperture upon pivoted movement of the right rail to the in-line position to lock the left rail and the right rail together in an in-line relation to one another.

34. The top rail of claim 20, wherein the right rail includes a pair of side walls arranged to lie in spaced-apart relation to define a rail-receiving space therebetween and the left rail includes a lock housing positioned to extend into the rail-receiving space and pivotably coupled to the side walls to establish the pivot axis.

35. The top rail of claim 34, wherein the lock housing is formed to include an interior region, the rail lock is positioned to lie in the interior region, and the lock housing is also formed to include a first button-mount aperture receiving the first lock button and a second button-mount aperture receiving the second lock button.

36. The top rail of claim 35, wherein a first of the side walls is formed to include a first locking aperture arranged to receive the first lock button upon pivoted movement of the right rail relative to the left rail about the pivot axis to assume the in-line position with the left rail and a second of the side walls is formed to include a second locking aperture arranged to receive the second lock button upon pivoted movement of the right rail relative to the left rail about the pivot axis to assume the in-line position.

37. A playyard top rail comprising a left rail segment, a lock housing coupled to the left rail segment, the lock housing being formed to include a button-mount aperture, a lock including a lock button mounted for movement in the button-mount aperture and a spring positioned to lie in an interior region formed in the lock housing and arranged to urge the lock button in a first direction through the button-mount aperture, a right rail segment, and a lockable frame coupled to the right rail segment and formed to include a locking aperture having an outer opening in an exterior wall of the lockable frame, the lock housing being pivotably coupled to the lockable frame to enable pivotable movement of the right rail segment relative to the left rail segment, the spring being sized to urge an outer portion of the lock button into the locking aperture formed in the lockable frame to position the outer portion of the lock button to be touched by a finger of a user that has been extended through the outer opening of the locking aperture while an inner portion of the lock button remains in the button-mount aperture formed in the lock housing upon pivoted movement of the right rail segment to assume an in-line position relative to the left rail segment to block pivotable movement of the lock housing relative to the lockable frame about the pivot axis.

38. The top rail of claim 37, wherein the lockable frame includes a pair of spaced-apart side walls and a curved bottom wall connected to a lower end of each of the side walls, the side walls and the bottom wall cooperate to define a saddle-shaped portion configured to receive the pivotable lock housing therein, and the locking aperture is formed in one of the side walls.

39. The top rail of claim 37, wherein the lock housing includes a first clamshell formed to include the button-mount aperture and a second clamshell coupled to the first clamshell to define the interior region.

* * * * *